US008231289B2

(12) United States Patent
Chen

(10) Patent No.: US 8,231,289 B2
(45) Date of Patent: Jul. 31, 2012

(54) LABEL TENSIONING BOARD OF LABEL PRINTER

(75) Inventor: Ching-Wen Chen, Taipei (TW)

(73) Assignee: TSC Auto ID Technology Co., Ltd., I-Lan Hsien (TW)

( * ) Notice: Subject to any disclaimer, the term of this patent is extended or adjusted under 35 U.S.C. 154(b) by 882 days.

(21) Appl. No.: 12/149,713

(22) Filed: May 7, 2008

(65) Prior Publication Data

US 2008/0279606 A1 Nov. 13, 2008

(30) Foreign Application Priority Data

May 8, 2007 (TW) ..... 96207366 U

(51) Int. Cl.
*B41J 11/00* (2006.01)

(52) U.S. Cl. ..... 400/618; 400/619

(58) Field of Classification Search ..... 400/207, 400/208, 618, 619; 347/214
See application file for complete search history.

(56) References Cited

U.S. PATENT DOCUMENTS 3,022,024 A * 2/1962 Tishken ..... 242/575.2
5,040,461 A * 8/1991 Van-Ocker ..... 101/288
5,587,044 A * 12/1996 Goto ..... 156/577
6,302,604 B1 * 10/2001 Bryant et al. ..... 400/619
6,336,757 B1 * 1/2002 Nishimura et al. ..... 400/613
6,607,316 B1 * 8/2003 Petteruti et al. ..... 400/82
6,622,622 B2 * 9/2003 Lee et al. ..... 101/228
6,712,112 B2 * 3/2004 Goodwin et al. ..... 156/577
6,805,183 B2 * 10/2004 Goodwin et al. ..... 156/577
2006/0239743 A1 * 10/2006 Naito ..... 400/208

* cited by examiner

*Primary Examiner* — Daniel J Colilla
*Assistant Examiner* — David Banh
(74) *Attorney, Agent, or Firm* — Rosenberg, Klein & Lee

(57) ABSTRACT

A label tensioning board is provided for a label printer, including a body, at least one shaft, a resilient element, and at least one slide. The body forms a slot for rotatably accommodating the shaft. The resilient element is coupled to a proximal end of the shaft and the proximal end of the shaft is fixed to an enclosure of the label printer to allow for resilient rotation and returning of the body for adjustment of tension. The body forms at least one rail and a stop. The slide slidably engages the rail for sliding movement along the rail. The slide forms a positioning projection for setting a space between the slide and the stop that accommodate and guides the conveyance of a sheet of label paper. As such, a tensioning board featuring both adjustment of label tension and positioning of the label is provided.

7 Claims, 5 Drawing Sheets

LABEL TENSIONING BOARD OF LABEL PRINTER

BACKGROUND OF THE INVENTION

1. Field of the Invention

The present invention relates to a label tensioning board of a label printer, and in particular to a label tensioning board that is applicable to a label printer and has a selectively-positioned slide for defining a conveyance path of a sheet of label paper.

2. The Related Arts

In a conventional label printer, labels to be printed are accommodated in the label printer. Labels of different specifications must be respectively adjusted for tension induced therein and conveyance path thereof must be adjusted and respectively set. Thus, the conventional label printer must be provided with a tensioning board and a label guiding unit that are accommodated inside an enclosure of the label printer. Installing separate tensioning board and label guiding unit inside the printer label requires additional installation cost and labor hours. Further, as the tensioning board and the label guiding unit are separate devices, they cannot be operated simultaneously. This makes it impossible to fully exploit the operation of these devices.

Thus, it is desired to have a label printer that has a label tensioning board featuring both functions of tension adjustment and guiding of conveyance of label paper to overcome the drawbacks discussed above.

SUMMARY OF THE INVENTION

An objective of the present invention is to provide a label tensioning board for a label printer, which overcomes the problems of label tensioning adjustment and guided conveyance of label associated assembling of the label printer and the loading of label sheets.

Another objective of the present invention is to provide a label tensioning board for a label printer, which functions as both a tensioning device for labels to be printed and a conveyance device for label sheets.

To achieve the above discussed objectives, in accordance with the present invention, a label tensioning board is provided for a label printer, comprising a body, at least one shaft, a resilient element, and at least one slide. The body forms a slot for rotatably accommodating the shaft. The resilient element is coupled to a proximal end of the shaft and the proximal end of the shaft is fixed to an enclosure of the label printer to allow for resilient rotation and returning of the body for adjustment of tension. The body forms at least one rail and a stop. The slide slidably engages the rail for sliding movement along the rail. The slide forms a positioning projection for setting a space between the slide and the stop that accommodate and guides the conveyance of a sheet of label paper. As such, a tensioning board featuring both adjustment of label tension and positioning of the label is provided.

BRIEF DESCRIPTION OF THE DRAWINGS

The present invention will be apparent to those skilled in the art by reading the following description of preferred embodiment thereof, with reference to the attached drawings, wherein.

DETAILED DESCRIPTION OF THE PREFERRED EMBODIMENT

Figure 1:
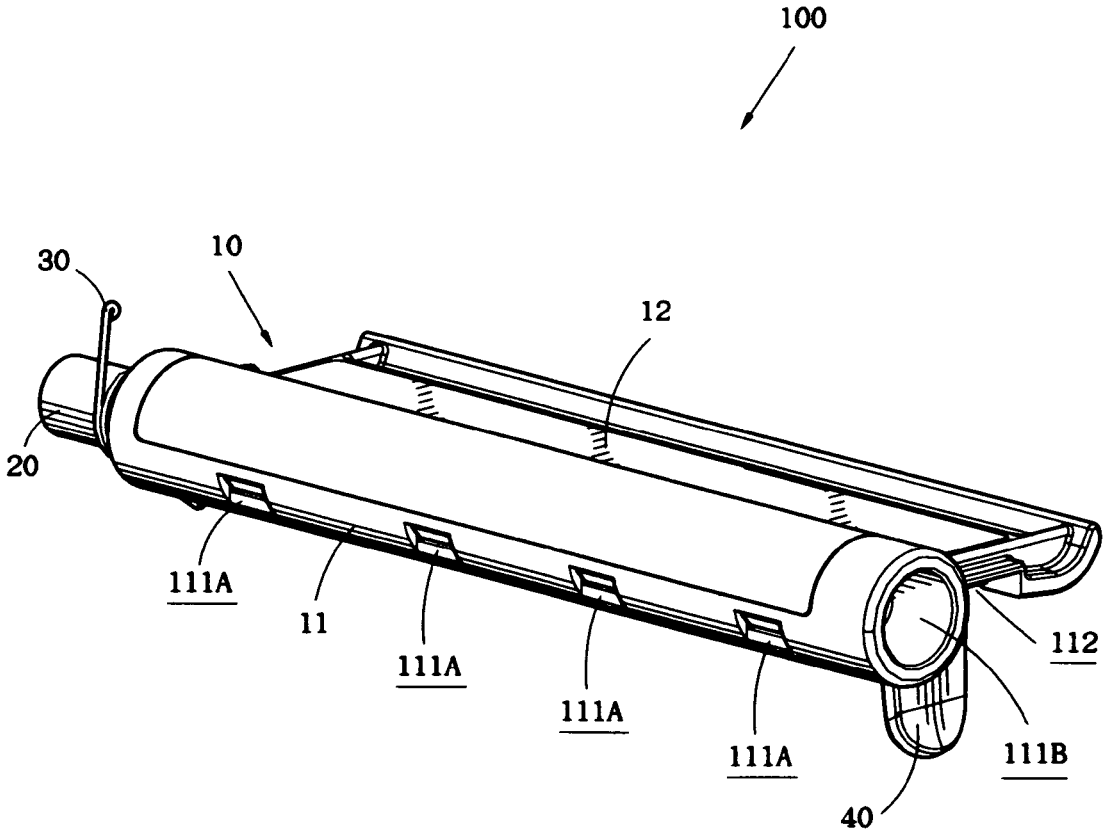
FIG. 1 is a perspective view of a tensioning board constructed in accordance with the present invention for use with a label printer.
Figure 2:
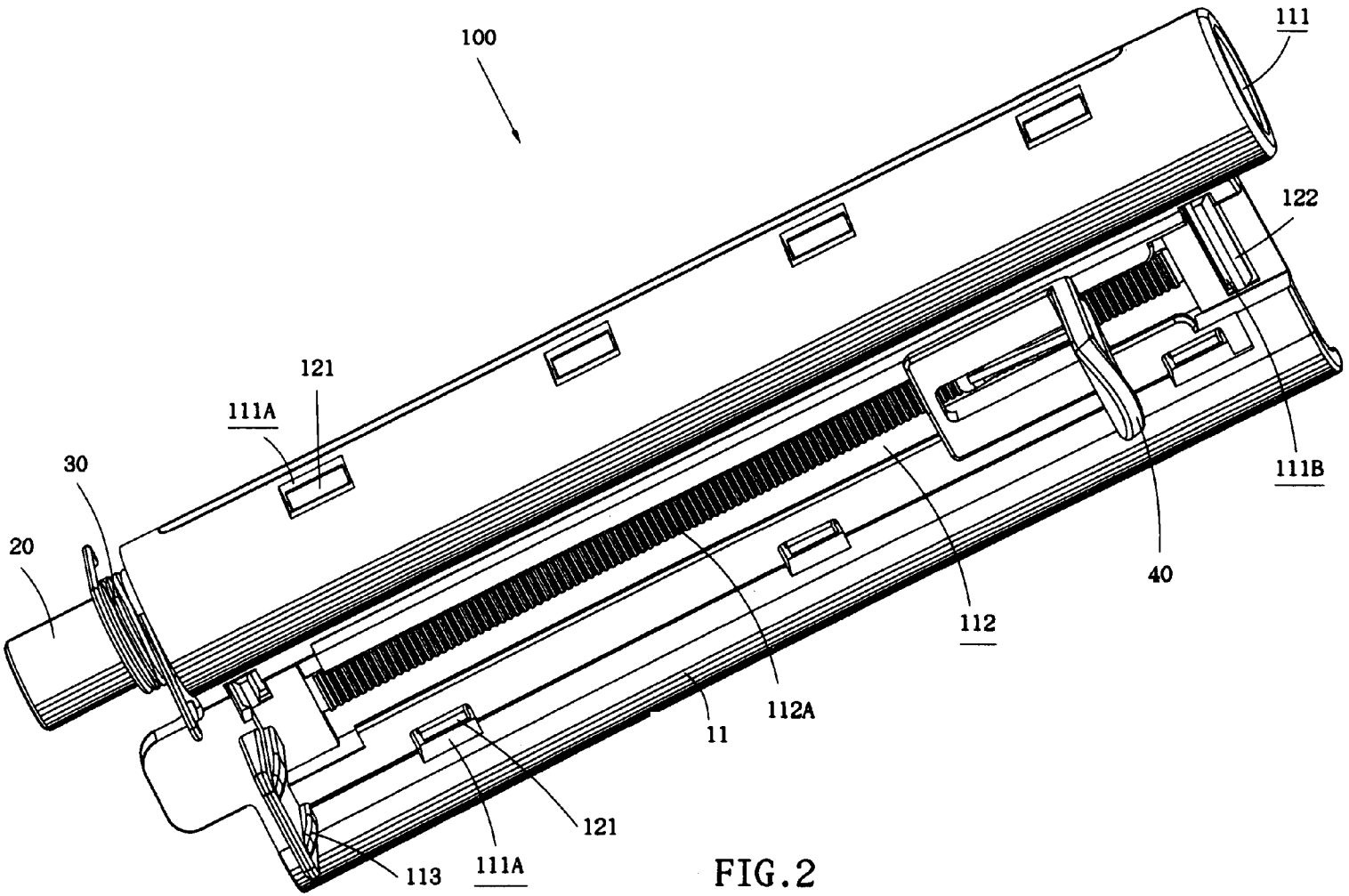
FIG. 2 is another perspective view of the tensioning board of the present invention.
Figure 3:
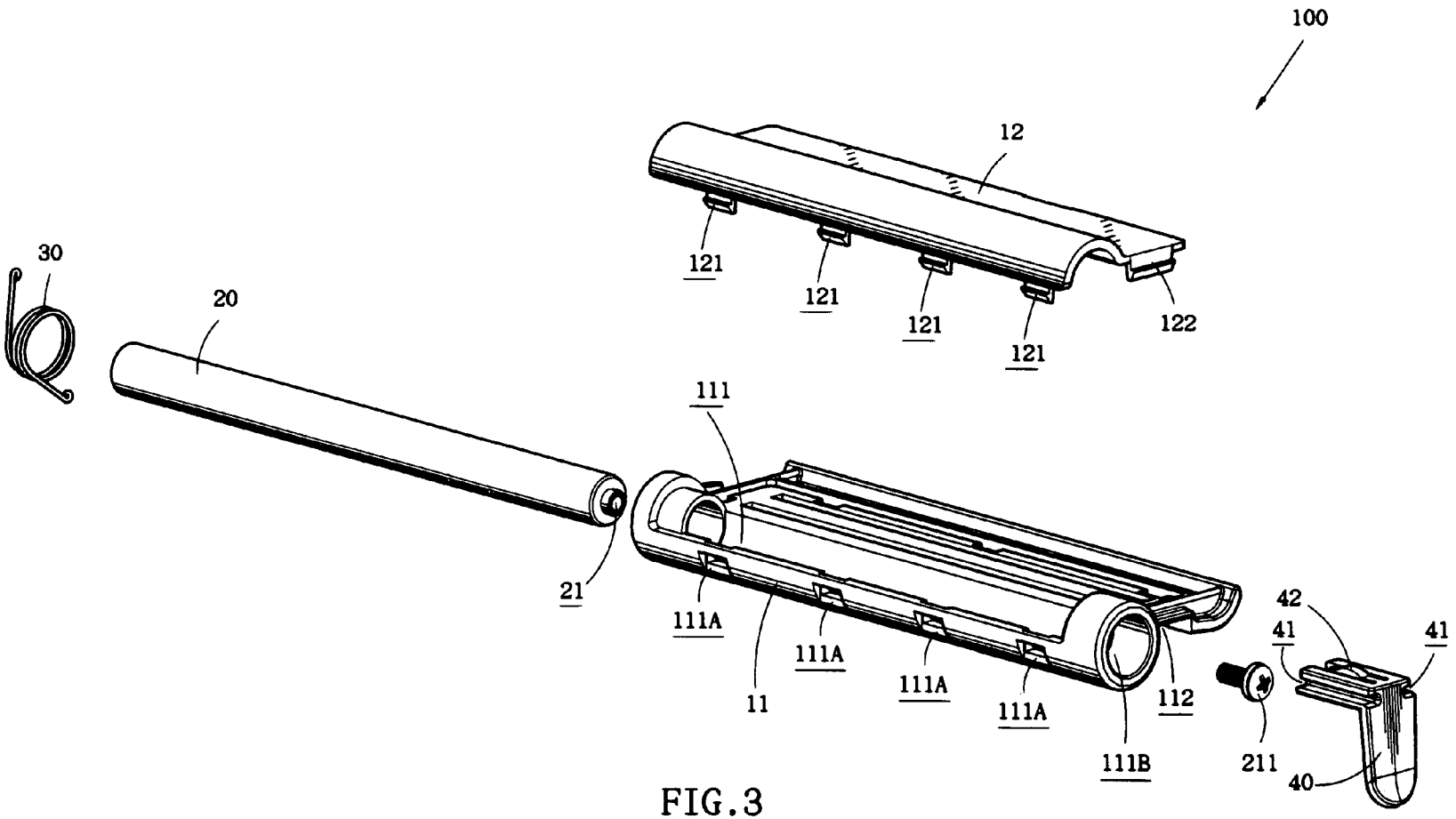
FIG. 3 is an exploded view of the tensioning board of the present invention.

With reference to the drawings and in particular to FIGS. 1-3, a label tensioning board 100 constructed in accordance with the present invention is provided for a label printer to adjust and set tension of printed label moving through the label printer. The label tensioning board 100 comprises a body 10, at least one shaft 20, a resilient element 30, and at least one slide 40. The body 10 comprises a lower casing member 11 and an upper casing member 12. The lower casing member 11 forms a slot 111 on one surface thereof opposing the upper casing member 12. The slot 111 is delimited by a side wall in which a plurality of openings 111A is defined. The lower casing member 11 forms a bore 111B at an end of the slot 111. The lower casing member 11 also forms, on an opposite surface thereof facing away from the upper casing member 12, a rail 112 and a stop 113 (see FIG. 2). The rail 112 can be of any form and a channel is taken as an example in the embodiment illustrated. Other structures that are equivalents in function of guiding movement, such as raised rail, can be used to replace the channel rail 112. A plurality of teeth 112A, see FIG. 2, is formed on an inside surface of the channel rail 112. The lower casing member 11 also forms a mounting hole 114 at an end thereof.

The upper casing member 12 forms a plurality of pawls 121 and an additional pawl 122 that are arranged along a circumference of the upper casing member 12 and respectively corresponding to the openings 111A and the mounting hole 114 of the lower casing member 11. The pawls 121 and 122 are engageable with the openings 111A and the mounting hole 114, respectively, to secure the upper and lower casing members 11, 12 together.

It is apparent that the body 10 of the label tensioning board 100 is not limited to the structure constituted by the upper and lower casing members 11, 12 as described above. Other equivalent structures can also be adopted and they are considered within the scope of the present invention.

The shaft 20 is rotatably received in the slot 111 of the lower casing member 11 of the body 10 and is retained partly by the upper casing member 12. A threaded hole 21 is defined in a distal end of the shaft 20 that corresponds to the bore 111B of the lower casing member 11 and is engageable with a threaded fastener 211, such as a bolt, to couple the shaft 20 to the lower casing member 11 in a rotatable manner.

The resilient element 30 is coupled to a proximal end of the shaft 20 and has an end mounted to the shaft 20 and an opposite end attached to the lower casing member 11 to provide a returning spring force to the shaft 20.

The slide 40 has opposite side faces in each of which a sliding portion 41 is formed, such as a sliding slot that is slidably fit over a side flange of the channel rail 112 of the lower casing member 11 of the body 10 to guide sliding movement of the slide 40 along the rail 112. The slide 40, which is slidably received in the channel rail 112 formed on the surface of the lower casing member 11, has a positioning projection 42 that is engageable with the teeth 112A of the rail 112 of the lower casing member 11 to thereby selectively position the slide 40 at a desired location along the rail 112 by sliding the slide 40 along the rail 112. In this respect, the projection 42 is preferably made resiliently deformable for positioning the slide 40 with respect to the lower casing member 11. In this way, a desired space can be formed between the slide 40 and stop 113 that is provided on the lower casing member 11 for the extension and passage of a label paper having a size corresponding tot he space.

Figure 4:
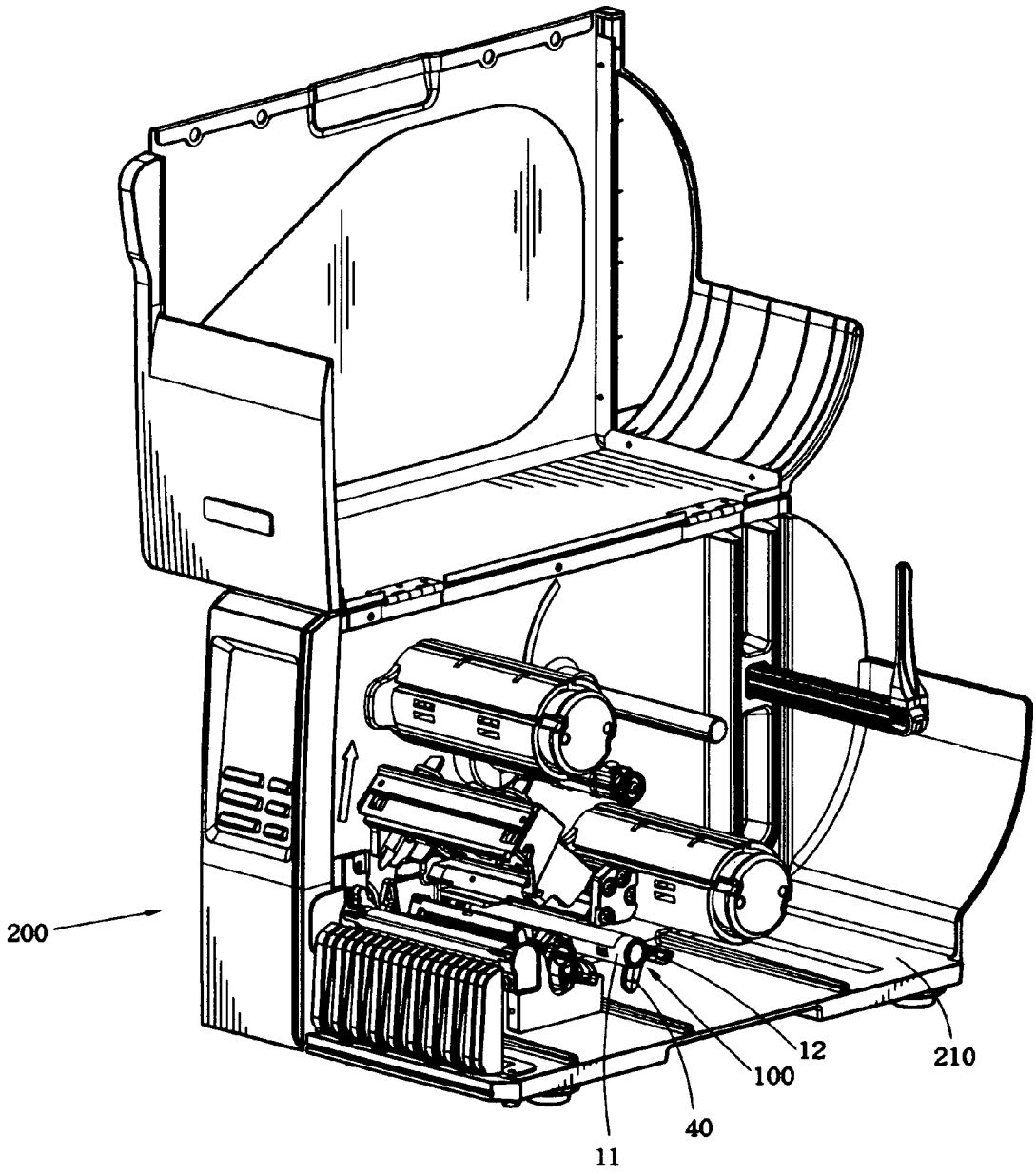
FIG. 4 is a perspective view illustrating a label printer in which the tensioning board of the present invention is incorporated;.
Figure 5:
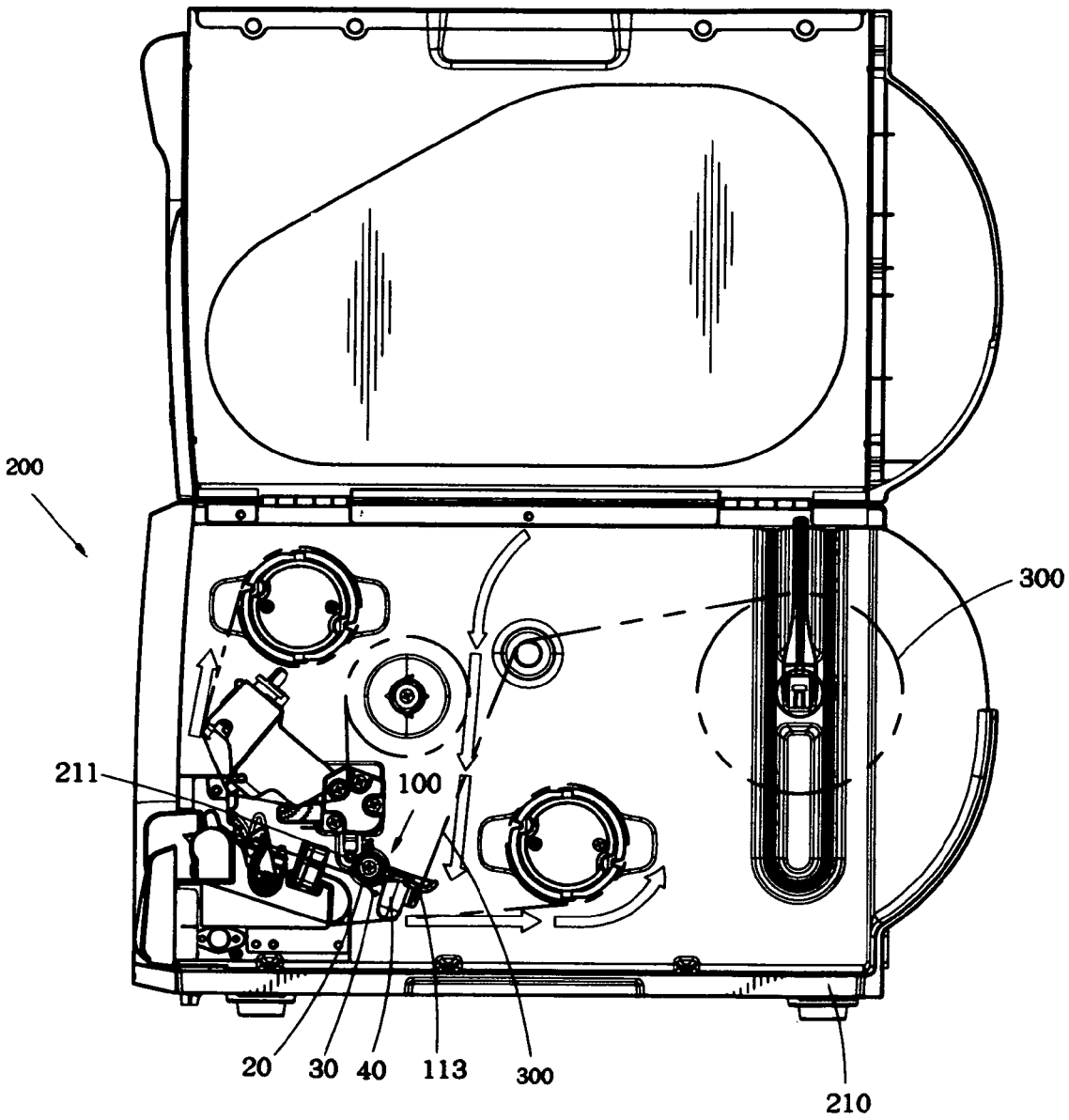
FIG. 5 is a front view of FIG. 4.

Also referring to FIGS. 4 and 5, a label printer, generally designated at 200, in which the label tensioning board 100 of the present invention is applied is illustrated. The label printer 200 has an enclosure 210 inside which the label tensioning board 100 is arranged, wherein the proximal end of the shaft 20 to which the resilient element 30 is mounted is fixed to a side wall of the enclosure 210 in such a way to allow rotation of the label tensioning board 100 with respect to the printer enclosure 210 within a limited range of rotation angle and also provide the tensioning board 100 with a resilient returning force for adjustment of tension. When a sheet of label paper 300 passes under the label tensioning board 100, the tension applied thereto can be adjusted by the label tensioning board 100 and the space between the slide 40 and the stop 113 of the lower casing member 11 can be adjusted by sliding the slide 40 along the rail 112 to accommodate the size of the particular label paper 300 passing through the label tensioning board 100 and thus securely guiding and conveying through the space between the slide 40 and the stop 113 of the lower casing member 11. Thus, adjustment of tension and guiding and conveying of the label paper 300 can be done simultaneously with a single label tensioning board 100.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A label tensioning board for a label printer, comprising:

a body including a main portion forming a slot therein and a transversely extended portion forming at least one slide rail on a surface thereof, the body also forming a stop on the surface;

a shaft rotatably accommodated in the slot of the body and having a first end coupled to an end of the slot and a second end coupled to a side wall of an enclosure;

a resilient element coaxially coupled the shaft for providing a torsional returning force on the body relative to the enclosure for tension adjustment of a sheet of label paper accommodated about said label tensioning board; and a slide having opposite side faces each forming a sliding portion slidably engageable to the slide rail of the body to allow for sliding movement of the slide along the slide rail and thus setting a space between the slide and the stop for accommodating and guiding the sheet of label paper;

wherein tension applied to the sheet of label paper is adjustable by said label tensioning board.

2. The label tensioning board as claimed in claim 1, wherein the slide rail forms a plurality of positioning teeth.

3. The label tensioning board as claimed in claim 1, wherein the slide rail comprises a channel defined in the surface of the body and slidably receiving the slide therein.

4. The label tensioning board as claimed in claim 1, wherein the body comprises:

a lower casing member, which has a first face forming the slot delimited by a side wall in which openings are defined, the lower casing member forming a bore corresponding to the first end of the shaft, the lower casing member having an opposite second face forming the slide rail and the stop, the lower casing member also forming a mounting hole; and an upper casing member, which forms pawls engageable with the openings and the mounting hole of the lower casing member to secure the lower and upper casing members together.

5. The label tensioning board as claimed in claim 4, wherein the slide rail forms a plurality of positioning teeth.

6. The label tensioning board as claimed in claim 4, wherein the slide rail comprises a channel defined in the surface of the body and slidably receiving the slide therein.

7. The label tensioning board as claimed in claim 1, wherein the slide forms a positioning projection selectively engageable with the rail to position the slide at a selected location along the rail.

* * * * *